US006557985B2

(12) United States Patent
Hosono et al.

(10) Patent No.: US 6,557,985 B2
(45) **Date of Patent: *May 6, 2003**

(54) INK JET RECORDING HEAD

(75) Inventors: Satoru Hosono, Nagano (JP); Tomoaki Takahashi, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/494,384

(22) Filed: Jan. 31, 2000

(65) Prior Publication Data

US 2002/0167569 A1 Nov. 14, 2002

(30) Foreign Application Priority Data

| | | |
|---|---|---|
| Jan. 29, 1999 | (JP) | 11-023304 |
| Aug. 19, 1999 | (JP) | 11-232694 |
| Nov. 29, 1999 | (JP) | 11-338161 |

(51) Int. Cl.[7] ..... B41J 2/045

(52) U.S. Cl. ..... 347/70; 347/68; 347/69; 347/71; 347/72

(58) Field of Search ..... 347/68, 69, 70, 347/71, 72, 85, 86, 87, 64–65, 94

(56) References Cited

U.S. PATENT DOCUMENTS

| | | | | |
|---|---|---|---|---|
| 4,216,477 A | * | 8/1980 | Matsuda et al. | 346/94 |
| 4,455,560 A | | 6/1984 | Louzil | 346/140 |
| 4,680,595 A | | 7/1987 | Cruz-Uribe et al. | 346/140 |
| 4,730,197 A | * | 3/1988 | Raman et al. | 347/68 |
| 5,087,930 A | * | 2/1992 | Roy et al. | 347/94 |
| 5,455,615 A | | 10/1995 | Burr et al. | 347/92 |
| 5,594,481 A | | 1/1997 | Keefe et al. | 347/65 |
| 5,781,212 A | | 7/1998 | Burr et al. | 347/84 |
| 5,828,390 A | | 10/1998 | Thiel | 347/40 |
| 5,988,798 A | * | 11/1999 | Hirasawa et al. | 347/65 |

FOREIGN PATENT DOCUMENTS

| | | | | |
|---|---|---|---|---|
| EP | 0 314 486 | | 5/1989 | B41J/3/04 |
| EP | 0 649 745 A1 | | 4/1995 | B41J/2/14 |
| EP | 0 691 204 A1 | | 1/1996 | B41J/2/14 |
| EP | 0695638 | * | 2/1996 | |
| GB | 2 022 021 A | | 12/1979 | B41J/3/04 |
| GB | 2 314 293 A | | 12/1997 | B41J/2/14 |
| JP | 56-136371 | | 10/1981 | B41J/3/04 |
| JP | 61-16863 | | 1/1986 | B41J/3/04 |
| JP | 61-100469 | | 5/1986 | B41J/3/04 |
| JP | 2-89648 | | 3/1990 | |
| JP | 4-355146 | | 12/1992 | |
| JP | 6-115087 | | 4/1994 | |
| JP | 8-580886 | | 3/1996 | |
| JP | 10-286959 | | 10/1998 | |
| JP | 11-129477 | | 5/1999 | B41J/2/045 |
| JP | 11-245399 | | 9/1999 | B41J/2/045 |

OTHER PUBLICATIONS

Japanese Abstract No. 58011175, dated Jan. 21, 1983.
Japanese Abstract No. 58007363, dated Jan. 17, 1983.
Japanese Abstract No. 09314832, dated Dec. 9, 1997.
Japanese Abstract No. 05246026, dated Sep. 24, 1993.
Japanese Patent Abstract 11129477 May 18, 1999.
Japanese Patent Abstract 11245399 Sep. 14, 1999.
Japanese Patent Abstract 61100469 May 19, 1986.
Japanese Patent Abstract 56136371 Oct. 24, 1981.
Japanese Patent Abstract 61016863 Jan. 24, 1986.
Partial European Search Report.

* cited by examiner

*Primary Examiner*—John Barlow
*Assistant Examiner*—Ly T Tran
(74) *Attorney, Agent, or Firm*—Sughrue Mion, PLLC

(57) ABSTRACT

In an end portion of a common ink reservoir, there is provided a narrowed area having a cross-sectional area decreased as compared with any other portion, inertance of each of ink supply channels communicating with the common ink reservoir in the narrowed area is set smaller than inertance of each of ink supply channels communicating with the common ink reservoir in any other portion than the narrowed area, inertance of each ink supply channel is set smaller as the ink supply channel is positioned at the tip of the common ink reservoir, and the volumes of pressure generating chambers are made uniform.

25 Claims, 11 Drawing Sheets

INK JET RECORDING HEAD

BACKGROUND OF THE INVENTION

This invention relates to an ink jet image recording apparatus used as an ink jet printer, an ink jet plotter, or the like and an ink jet recording head incorporated therein.

A recording head in a related art adopts a configuration wherein a plurality of pressure generating chambers each having a nozzle orifice are formed side by side, an elongated common ink reservoir is formed along an arrangement direction of the pressure generating chambers, the common ink reservoir and the pressure generating chambers are made to communicate with each other by ink supply channels, each pressure generating chamber is provided with a pressure generating element via a vibration plate, and an ink drop is jetted through the nozzle orifice as the pressure generating element causes pressure fluctuation to occur in the pressure generating chamber. The common ink reservoir has a tapering-off shape with the flow passage width narrowed at left and right end portions at the most distance from an ink supply tube for supplying ink to the common ink reservoir for the purpose of decreasing the cross-sectional area, thereby increasing the flow velocity of ink, thereby eliminating remaining bubbles at the time of filling with ink or at the cleaning time of sucking through the nozzle orifices.

One face of the common ink reservoir is partitioned by an elastic film, thereby giving large compliance for the purposes of absorbing pressure of ink flowing backward from the ink supply channel at the ink jetting time and supplying ink to each pressure generating chamber quickly.

However, with the recording head in the related art, if the pressure generating elements are driven under the same condition, a phenomenon occurs in which the jet characteristic of an ink drop jetted through the nozzle orifice of the pressure generating chamber communicating with the common ink reservoir at the end portion thereof (end portion at a distant from the ink supply tube) differs from the jet characteristic of an ink drop jetted through any other nozzle orifice. It is estimated that such a phenomenon occurs because a pressure loss occurs at the end portion of the common ink reservoir and negative pressure occurs at the entrance of the ink supply channel. To solve the problem, it is considered that the compliance of the common ink reservoir is enlarged, but the end portion of the common ink reservoir needs to be tapered off to enhance the bubble excluding capability and thus it is difficult to simply expand the portion having compliance.

There is a tendency to increase the number of nozzles per row from the requirements of speeding up image record, upsizing of the record target, etc.; however, if a cleaning pump is upsized and the bubble excluding capability is enhanced, the amount of excluded ink increases and thus tapering off the tip of the common ink reservoir is inevitable.

SUMMARY OF THE INVENTION

It is therefore an object of the invention to provide an ink jet recording head comprising a plurality of nozzle orifices and enabling the jet characteristics of the nozzle orifices to be made uniform and to provide an image recording apparatus incorporating the above ink jet recording head.

According to the first aspect of the invention, there is provided an ink jet recording head comprising:

a common ink reservoir;

an ink supply passage for supplying ink to the common ink reservoir;

a plurality of cavities arranged in a longitudinal direction of the common ink reservoir, which are to be pressure generating chambers; and an ink supply channel communicating the common ink reservoir and the respective cavities, wherein at least one ink supply channel situated in the vicinity of at least one longitudinal end portion of the common ink reservoir has at least one of a different cross-section area and a different length from the other ink supply channels.

According to the second aspect of the invention, in the ink jet recording head of the first aspect, the ink supply passage communicates with the common ink reservoir substantially at the center of the longitudinal direction thereof.

According to the third aspect of the invention, in the ink jet recording head of the first or second aspect, a cross-sectional area of the common ink reservoir is reduced at the end portion thereof.

According to the fourth aspect of the invention, in the ink jet recording head of any of the first to third aspects, vibration damping coefficients of the respective ink supply channels are substantially the same.

According to the fifth aspect of the invention, there is provided an ink jet recording head comprising:

a common ink reservoir in which a cross-sectional area of at least one longitudinal end portion is reduced;

an ink supply passage for supplying ink to the common ink reservoir;

a plurality of cavities arranged in a longitudinal direction of the common ink reservoir, which are to be pressure generating chambers; and an ink supply channel communicating the common ink reservoir and the respective cavities, wherein an inertance of at least one ink supply channel situated in the vicinity of the longitudinal end portion of the common ink reservoir is smaller than an inertance of the other ink supply channels.

According to the sixth aspect of the invention, in the recording head of the fifth aspect, the volume of the respective cavities is made constant.

According to the seventh aspect of the invention, there is provided an ink jet recording head comprising:

a common ink reservoir in which a cross-sectional area of at least one longitudinal end portion is reduced;

an ink supply passage for supplying ink to the common ink reservoir;

a plurality of cavities arranged in a longitudinal direction of the common ink reservoir, which are to be pressure generating chambers;

an ink supply channel communicating the common ink reservoir and the respective cavities; and an hypothetical ink supply channel defined as a sum of the length of the ink supply channel situated in the vicinity of the end portion of the common reservoir and the length from a point where the cross-sectional area of the common ink reservoir is started to be reduced to a point of the ink supply channel communicating with the common ink reservoir, wherein an inertance of the respective hypothetical ink supply channels is identical with an inertance of the respective other ink supply channels.

According to the eighth aspect of the invention, in the recording head of the seventh aspect, the volume of the respective cavities is made constant.

According to the ninth aspect of the invention, in the ink jet recording head of any of the fifth to eighth aspects, the ink supply channel situated in the vicinity of the end portion of the common ink reservoir has at least one of a different cross-section area and a different length from the other ink supply channels to determine the inertance thereof.

According to the tenth aspect of the invention, in the ink jet recording head of any of the fifth to ninth aspects, the ink supply channels communicate with the associated cavities on an hypothetical line extending in the arrangement direction of the cavities.

According to the eleventh aspect of the invention, in the ink jet recording head of any of the fifth to tenth aspects, the length of the ink supply channel situated in the vicinity of the end portion of the common ink reservoir is reduced. A compliance region of the common ink reservoir in the vicinity of the end portion thereof is expanded in accordance with the reduced amount of the length of the ink supply channel.

According to the twelfth aspect of the invention, in the ink jet recording head of any of the third to eleventh aspects, the cross-sectional area is reduced stepwise.

According to the thirteenth aspect of the invention, in the ink jet recording head of any of the first to twelfth aspects, a partition divides each ink supply channel into a plurality of channels.

According to the fourteenth aspect of the invention, in the ink jet recording head of any of the first to thirteenth aspects, the respective ink supply channels and a part of the respective cavities are divided by a partition wall such that an upper section and a lower section are defined. The divided sections are communicated with each other. At least one of the upper section and the lower section of the ink supply channels are divided by at least one partition into the plural channels.

According to the fifteenth aspect of the invention, in the ink jet recording head of the fourteenth aspect, the partitions provided in the respective upper sections of the ink supply channels are arranged in accordance with positions of piezoelectric elements to be mounted on a top wall of the respective cavities. The partitions provided in the respective lower sections of the ink supply channels are arranged in accordance with the positions of the partitions provided in the upper sections such that the volume of the respective cavities is made constant.

According to the sixteenth aspect of the invention, in the ink jet recording head of the fourteenth of fifteenth aspect, an inertance of the respective upper sections of the ink supply channels and an inertance of the respective lower sections of the ink supply channels are different.

According to the seventeenth aspect of the invention, there is provided an ink jet recording apparatus comprising:

a common ink reservoir;

an ink supply passage for supplying ink to the common ink reservoir;

a plurality of cavities arranged in a longitudinal direction of the common ink reservoir, which are to be pressure generating chambers; and an ink supply channel communicating the common ink reservoir and the respective cavities;

a nozzle orifice formed in the respective cavities;

a pressure generator for pressurizing the respective pressure generating chambers to eject an ink drop therefrom; and a controller for generating a drive signal to control the pressure generator, wherein the speed of the ink drop ejected from the respective nozzle orifices is within ±5% of a desired value when the respective pressure generating chambers are pressurized by the pressure generator in accordance with the substantially same drive signal.

According to the eighteenth aspect of the invention, in the ink jet recording head of the seventeenth aspect, at least one ink supply channel situated in the vicinity of at least one longitudinal end portion of the common ink reservoir has at least one of a different cross-section area and a different length from the other ink supply channels.

According to the nineteenth aspect of the invention, there is provided an ink jet recording apparatus comprising an ink jet recording head of any of the first to seventeenth aspects.

DETAILED DESCRIPTION OF THE PREFERRED EMBODIMENTS

Referring now to the accompanying drawings, there are shown embodiments of the invention.

Figure 1:
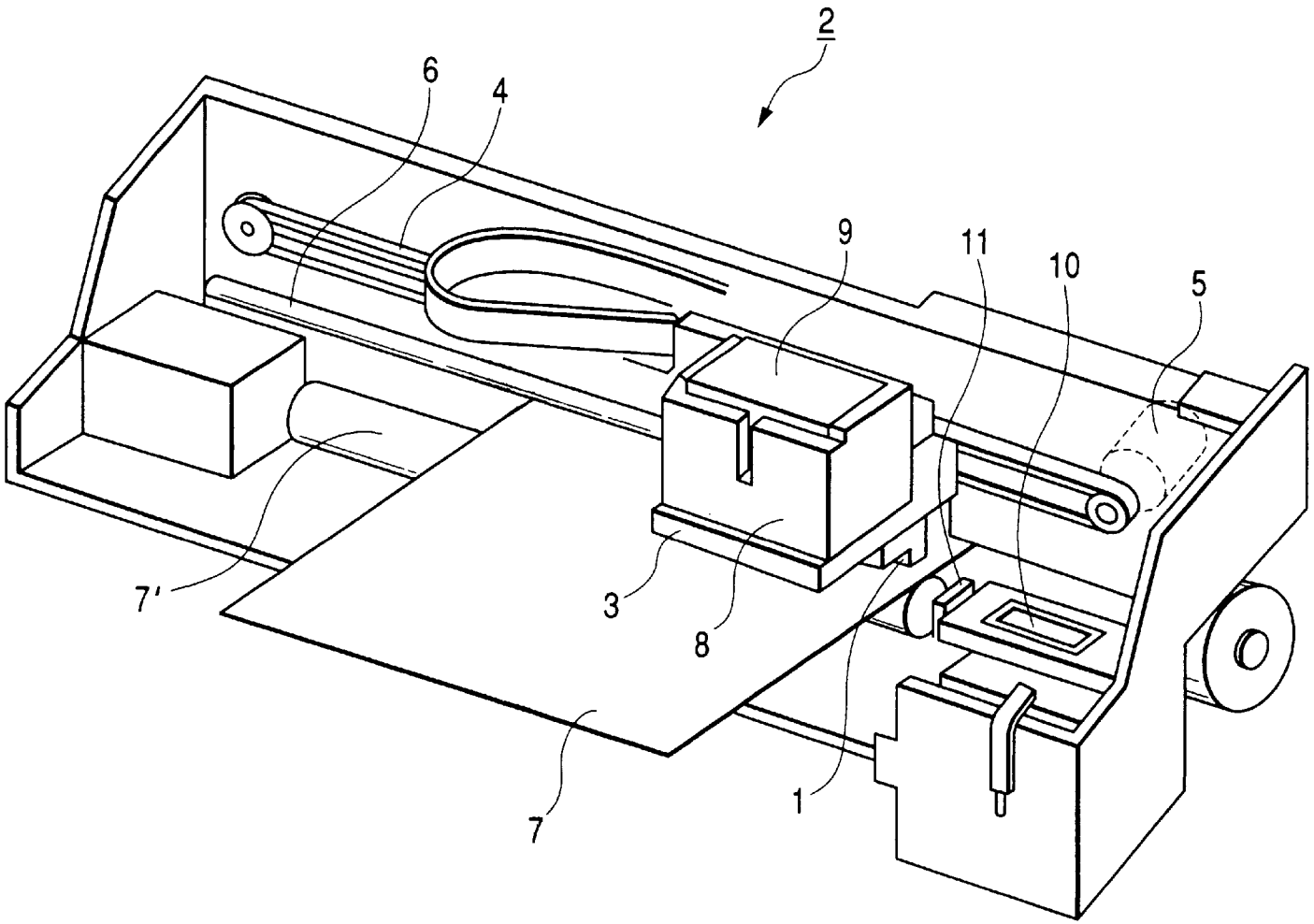
FIG. 1 is a perspective view of an image recording apparatus using an ink jet recording head of the present invention.

FIG. 1 is a perspective view of an image recording apparatus 2 using an ink jet recording head, which will be hereinafter referred to as a recording head 1.

The image recording apparatus 2 is used in a state in which it is connected to a computer (not shown) together with a scanner (not shown). A predetermined program is loaded into the computer and is executed, whereby the whole of the machines functions as a recording apparatus in one piece. In the computer, an application program operates under the control of a predetermined operating system and while predetermined processing is preformed for an image, etc., read through the scanner, an image is displayed on a CRT display (not shown). When the application program issues a print instruction, the computer outputs the image data read through the scanner, the text data entered through a keyboard, and the like to the image recording apparatus 2.

The image recording apparatus 2 comprises a carriage 3 connected to a carriage motor 5 via a timing belt 4 and guided by a guide member 6 for reciprocating in the paper width direction of recording paper 7. The image recording apparatus 2 is also provided with a paper feed mechanism using a paper feed roller 7'. A recording head 1 is attached to the face of the image recording apparatus 2 opposed to the recording paper 7, namely, the bottom face in the embodiment. It receives ink supplied from an ink cartridge 9 set on a holder 8 attached to the top of the carriage 3 and jets ink drops onto the recording paper 7 as the carriage 3 moves, thereby printing an image, text, etc.

A capping unit 10 is disposed in a non-printing area (non-recording area) out of the recording paper 7 for sealing nozzle orifices of the recording head 1 while printing is not performed. Therefore, an increase in viscosity of ink or formation of an ink film can be suppressed. The capping unit 10 is connected to a pump via a suction pipe although not shown; sucking is executed through the nozzle orifices for excluding bubbles in an ink flow passage in the recording head 1 when ink is newly filled or when a cleaning operation is executed.

The surface of the recording head 1 (the bottom face formed with the nozzle orifices) is wiped off by a wiping unit 11 placed in the proximity of the capping unit 10 for removing ink sediments, paper powder, etc., deposited on the surface of the recording head 1.

Figure 2:
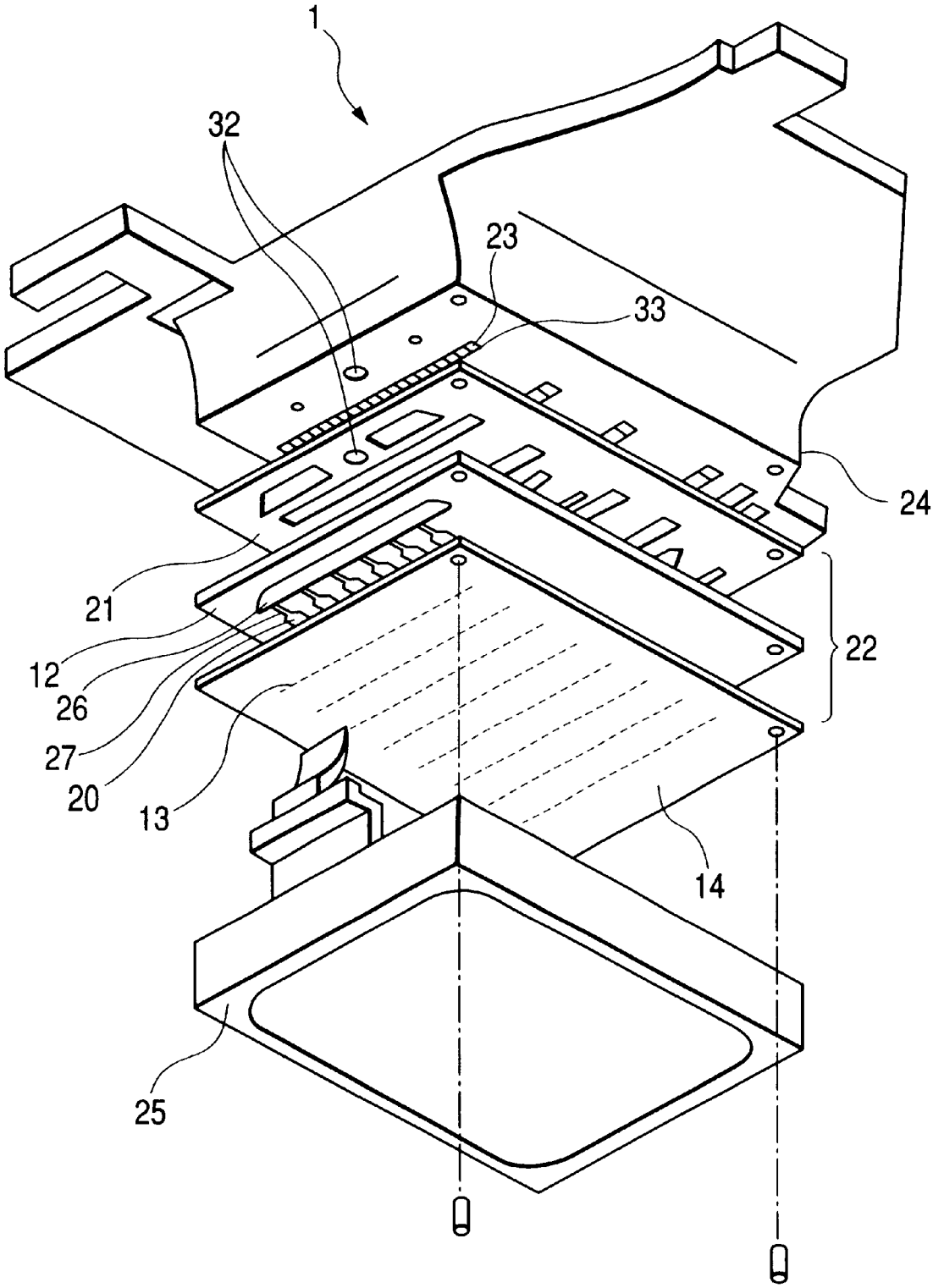
FIG. 2 is an exploded perspective view of the recording head of FIG. 1.
Figure 3:
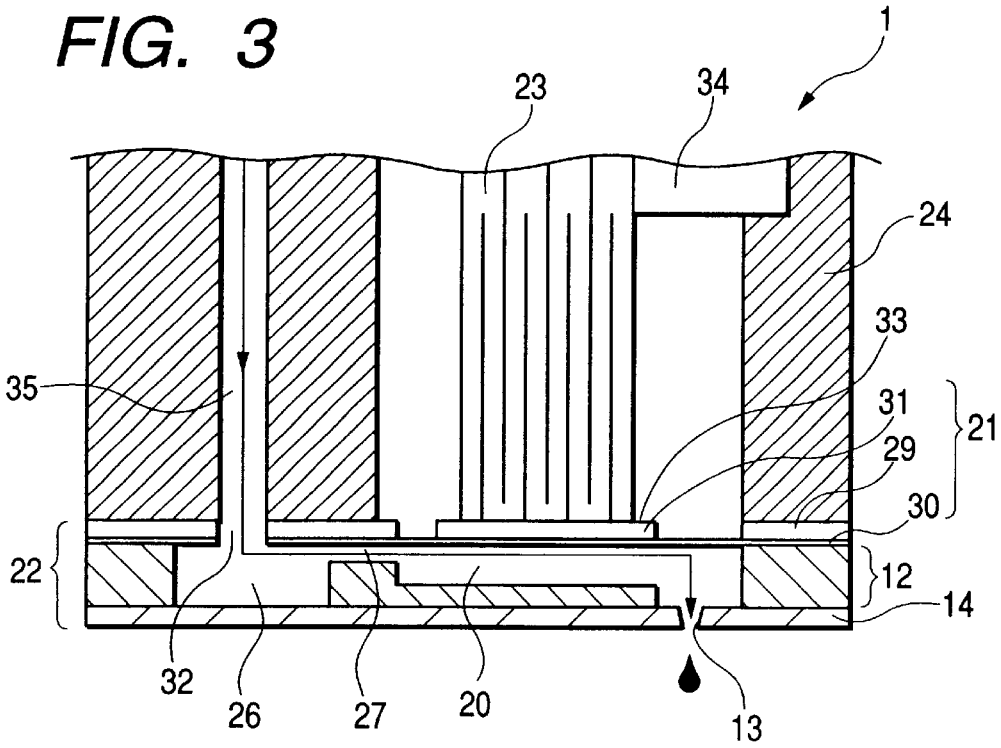
FIG. 3 is a sectional view of an actuator formed in the recording head.
Figure 4:
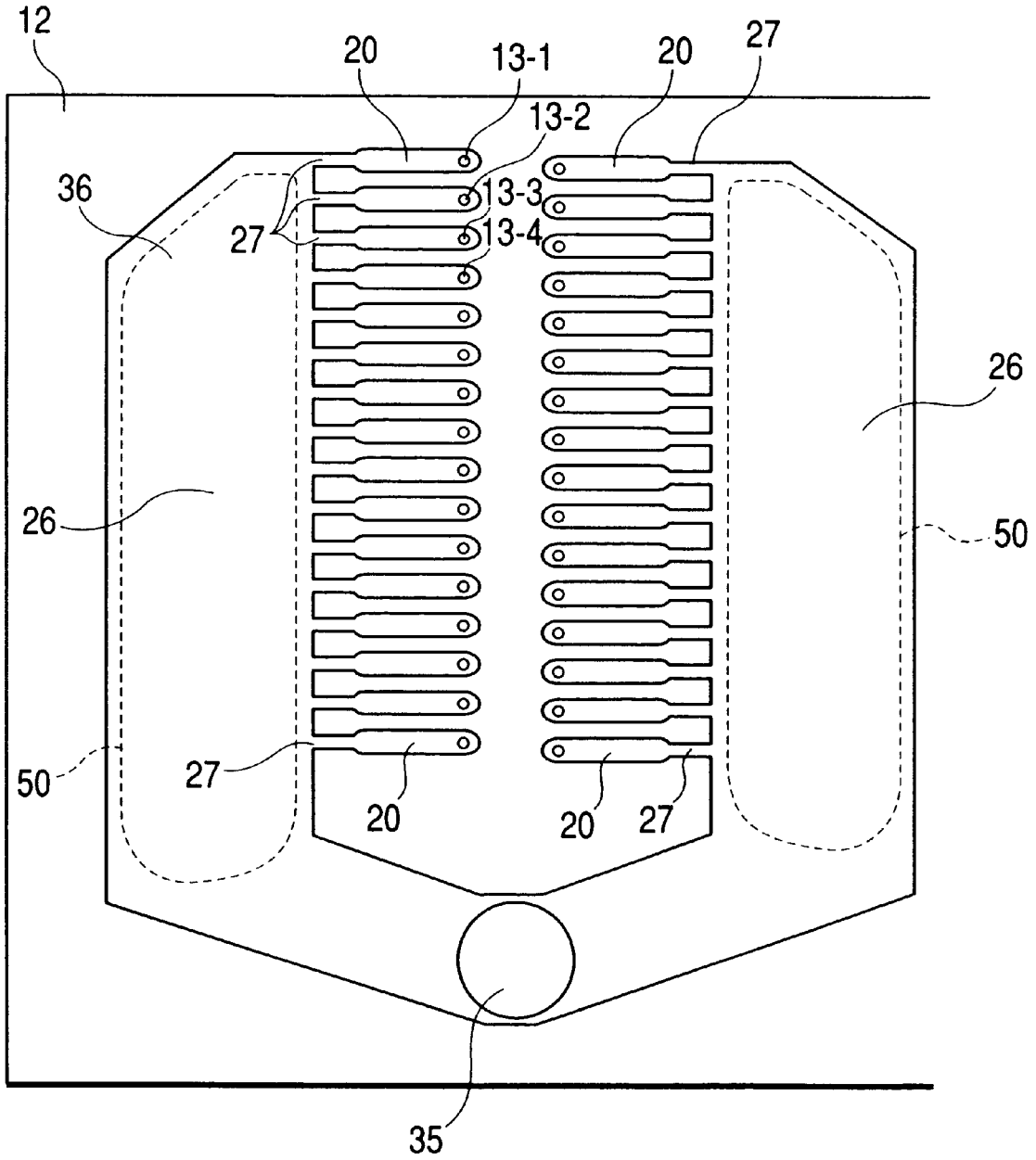
FIG. 4 is a plan view of a first embodiment of a channel formation substrate.

FIG. 2 is an exploded perspective view of the recording head 1 of the ink jet image recording apparatus 2 shown in FIG. 1. FIG. 3 is a sectional view of an actuator of the recording head 1. FIG. 4 is a plan view of a channel formation substrate 12 of the recording head 1.

To manufacture the recording head 1 shown in FIGS. 1 and 2, a nozzle plate 14 formed with rows of nozzle orifices 13, a channel formation substrate 12 formed with pressure generating chambers 20 communicating with the nozzle orifices 13, and an elastic plate 21 formed with vibration areas overlapping the pressure generating chambers 20 like islands are deposited in this order for forming a channel unit 22, then the channel unit 22 is superposed on a head case supporting pressure generating elements 23, the tips of the pressure generating elements 23 are abutted against and bonded to the vibration areas of the elastic plate 21, and the nozzle plate 14 side is covered with a margin cover 25.

The nozzle plate 14 comprises a thin plate such as a stainless plate formed with the nozzle orifices 13 of 20 $\mu$m to 30 $\mu$m in diameter at pitches corresponding to the dot formation density. As shown in FIG. 4, the channel formation substrate 12 comprises a silicon substrate about 400 $\mu$m thick formed with through holes by wet etching, etc., and the through holes form a common ink reservoir 26, elongated ink supply channels 27 formed from the common ink reservoir 26 to positions overlapping the nozzle orifices 13 in the nozzle plate 14, and the pressure generating chambers 20.

The elastic plate 21 comprises a composite plate consisting of a stainless plate 29 and a resin film 30 with stainless portions left as island-like vibration areas (island portions) 31 in the areas overlapping the pressure generating chambers 20 like islands and only the resin film 30 left surrounding each vibration area 31. The elastic plate 21 is formed with an ink supply hole 32 in the area overlapping the common ink reservoir 26.

The head case 24 has a window 33 formed on the tip face. When the pressure generating elements 23 formed like comb teeth with the base end fixed to a stainless fixation substrate 34 are inserted into the head case 24, the tip of the pressure generating element 23 enters the inside of the window 33. The head case 24 is formed with an ink supply passage 35.

In the described recording head 1, when a voltage pulse is applied to the pressure generating element 23, the pressure generating element 23 is contracted so as to expand the volume of the pressure generating chamber 20, causing negative pressure to occur in the pressure generating chamber 20. As a result, a meniscus of ink is pulled into the inside of the nozzle orifice 13 and ink flows into the pressure generating chamber 20 via the ink supply channel 27 from the common ink reservoir 26. On the other hand, when a discharge pulse is applied to the pressure generating element 23, the pressure generating element 23 is expanded so as to contract the volume of the pressure generating chamber 20, namely, causing positive pressure to occur in the pressure generating chamber 20. As a result, an ink drop is jetted through the nozzle orifice 13. In the operation, expansion and contraction of the pressure generating element 23 are transferred via the vibration area 31 of the elastic plate 21.

The embodiment of the channel formation substrate 12 shown in FIG. 4 is characterized by the fact that the ink supply passage 35 communicates with one end portion of the common ink reservoir 26 and thus the ink supply channels 27 communicating with the common ink reservoir 26 in the area of an opposite end portion at a distance from the ink supply passage 35 are widened gradually in the direction from a nozzle 13-4 to a nozzle 13-1. In other words, the ink supply channels 27 are widened gradually as they are positioned from the center of the common ink reservoir 26 to the tip thereof.

The common ink reservoir 26 formed in the channel formation substrate 12 has a uniform depth, so that the cross-sectional areas of the entrances of the ink supply channels 27 (supply ports corresponding to the nozzle 13-4 to the nozzle 13-1) are gradually increased and variations in the ink velocity and the ink amount occurring from the nozzle 13-4 to the nozzle 13-1 can be suppressed.

The principle will be discussed with reference to FIG. 5.

Mn, Ms, and Ma are inertance of the nozzle orifice 13, that of the ink supply channel 27, and that of the pressure generating element 23 respectively. Rn, Rs, and Ra are resistance of the nozzle orifice 13, that of the ink supply channel 27, and that of the pressure generating element 23 respectively. Cn, Cc and Ca are compliance of the nozzle orifice 13, that of the pressure generating chamber 20 and that of the pressure generating element 23, respectively. Us and Un are volume velocity of ink flowing into the nozzle orifice 13 side and that flowing into the ink supply channel 27 side. Ua is volume velocity of ink per unit time occurring in the pressure generating chamber 20 when the pressure generating element 23 operates. Therefore, the sum of the volume velocities Un and Us becomes Ua.

Oscillation frequency of ink flowing in the pressure generating chamber 20 (Fink) is represented by the following expression:

$$Fink = \frac{1}{2\pi}\sqrt{\frac{Mn \cdot Ms}{Cc(Mn + Ms)}}$$

In the embodiment, Mn=$1.27\times10^8$ (kg/m$^4$), Ms=$1.50\times10^8$ (kg/m$^4$), and Cc=$2.44\times10^{-20}$ (m$^5$/N), thus Fink results in about 123 kHz.

Although the ratio between Un and Us is determined by the ratio between impedance on the nozzle side, Zn, and impedance on the ink supply side, Zs, it can be considered that Zn≈Mn and that Zs≈Ms because Fink is very high speed.

Therefore, Un/Us≈Mn/Ms, and Un/Us can be controlled by adjusting Ms of ink supply port. Since it can be considered that the velocity of ink jetted through the nozzle orifice 13 is volume velocity Un (m$^3$/s)divided by nozzle orifice area (m$^2$), if Un is lessened, the ink velocity can be decreased. Likewise, if Un is lessened, the ink amount can also be decreased.

Ms can be represented by the following expression:

$$Ms = \frac{\rho l}{S}$$

where p: Specific gravity of ink

I: Length of ink supply channel 27

S: Cross-sectional area of ink supply channel 27

Thus, the cross-sectional area of the ink supply channel 27, S, is enlarged, whereby Ms lessens and the ink velocity and the ink amount can be controlled.

If the length of the ink supply channel 27 is shortened, a similar effect can be provided as described above.

Figure 6:
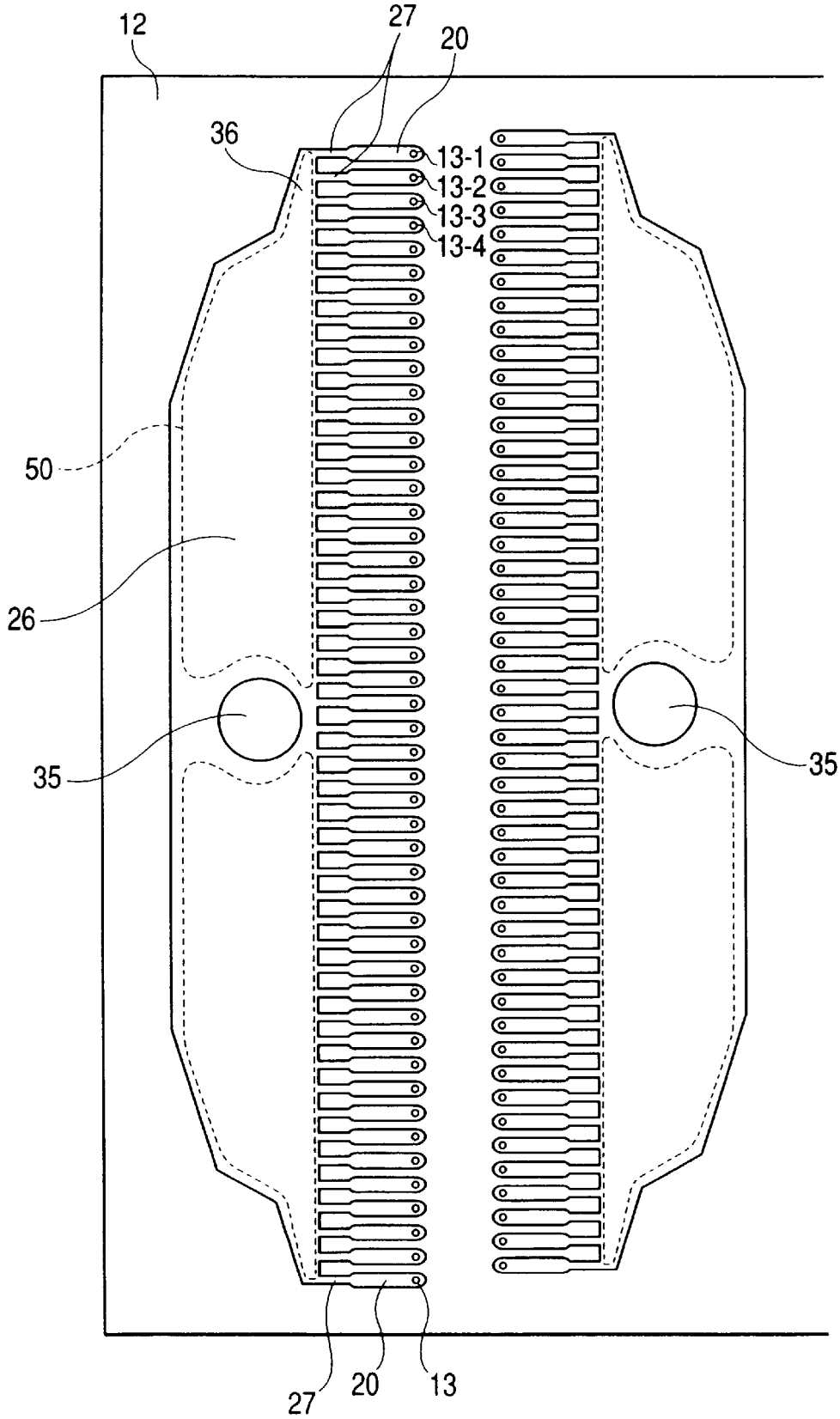
FIG. 6 is a plan view of a second embodiment of a channel formation substrate.

Next, a second embodiment of the invention shown in FIG. 6 will be discussed. The second embodiment of the invention is characterized by the fact that an ink supply passage 35 is positioned roughly at the center with respect to the length direction of a common ink reservoir 26. Such a composition makes it possible to make the length from the ink supply passage 35 to the end portion of the common ink reservoir 26 about a half that in the first embodiment; if the nozzle row becomes long, a head loss problem caused by the cross-sectional area and the length of the common ink reservoir 26 can be circumvented.

In the embodiment, the distance from the ink supply passage 35 to one end portion of the common ink reservoir 26 becomes the same as that from the ink supply passage 35 to an opposite end portion of the common ink reservoir 26, thus both end portions are shaped so as to taper off with the cross-sectional areas gradually decreasing, and ink supply channels 27 communicating with the common ink reservoir 26 in the area of the tapered-off end portion (narrowed area 36) are widened gradually as they are positioned from the center to the tip.

Figure 7:
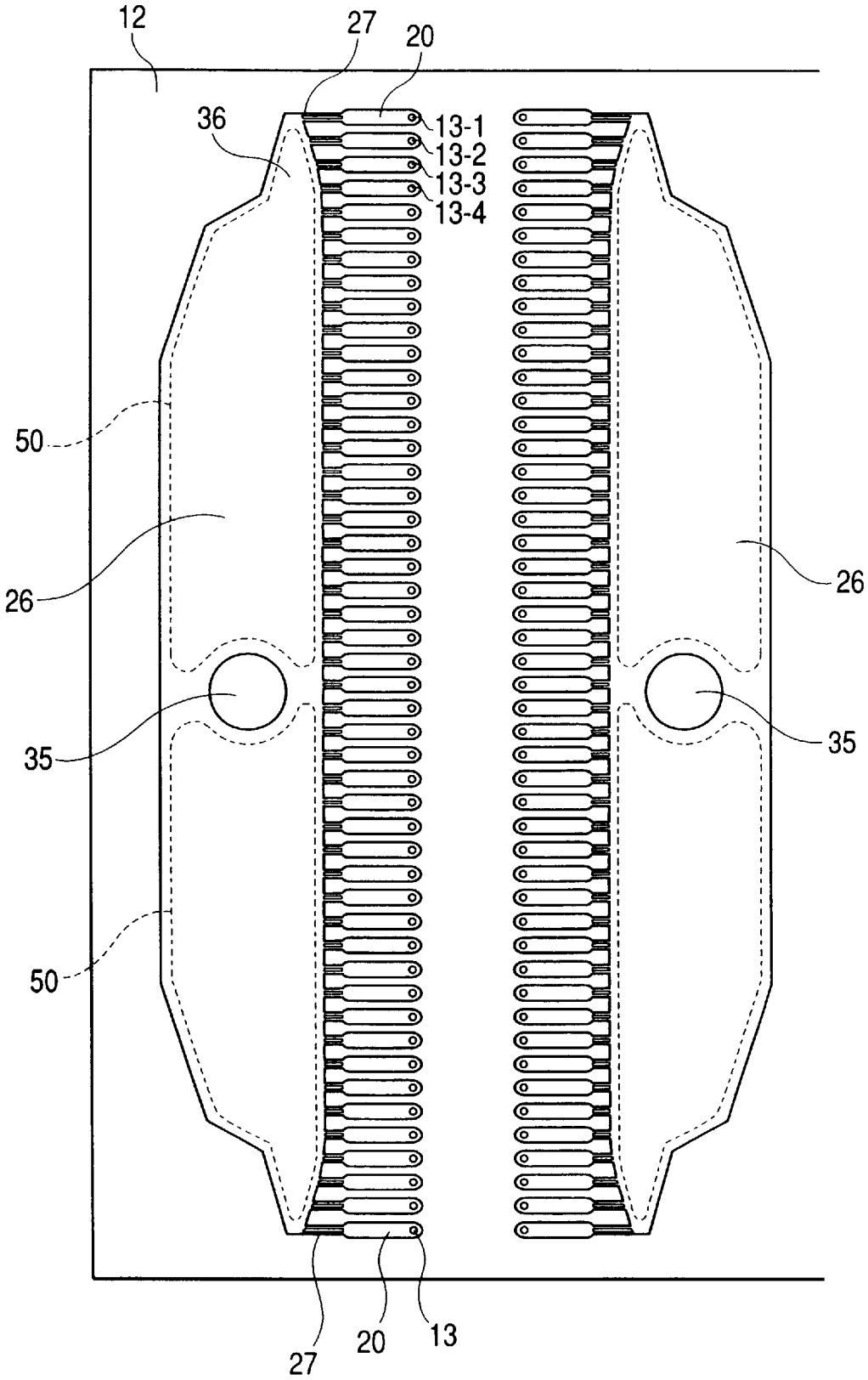
FIG. 7 is a plan view of a third embodiment of a channel formation substrate.

Next, a third embodiment of the invention shown in FIG. 7 will be discussed. The third embodiment of the invention is characterized by the fact that a plurality of ink supply channels 27 are formed for one pressure generating chamber 20.

In the first embodiment, the common ink reservoir 26 is excellent in bubble excluding capability and the ink amount and the ink velocity at the end portion can be corrected; to further speed up recording, it is necessary to efficiently attenuate vibration of ink in the pressure generating chamber 20.

Generally, an attenuation coefficient can be represented by Ms/Rs.

Here, Rs can be represented by the following expression:

$$Rs = \frac{12\eta l}{Wt^3}$$

where

η: Viscosity of ink (Pa·s)

l: Length of supply port (ink supply channel 27) (m)

W: Long side of cross section of supply port (when supply port has a rectangular cross section)

t: Short side of cross section of supply port (when supply port has a rectangular cross section).

In the embodiment, a channel formation substrate 12 is 200–500 μm thick and an ink supply channel 27 is 10–50 μm wide, thus if an attempt is made to lessen Ms by adjusting the width of the ink supply channel 27 as in the first embodiment, Rs lessens in proportion to the third power of the width.

As the attenuation coefficient Mn/Rn is smaller, vibration of ink can be attenuated more quickly; however, the ink velocity and the ink amount can be lessened by adjusting the width of the ink supply channel 27, but attenuation worsens, getting in the way of realizing high-speed printing.

However, the third embodiment is characterized by the fact that a plurality of ink supply channels 27 re provided for one pressure generating chamber 20, so that Mn can be considered in parallel, and it is made possible to adjust Mn small at the end portion as equivalent to the ink supply channel 27 with the attenuation coefficient Mn/Rn not corrected by adjusting the length l, the width W, and the depth t of the ink supply channel 27.

In the embodiment, a partition, etc., is not formed in the ink supply channel 27, but the inside of one ink supply channel 27 may branch up and down or left and right and merge in the pressure generating chamber 20.

In the embodiments described so far, of the ink supply channels 27 communicating with the common ink reservoir 26, the ink supply channels 27 communicating with the common ink reservoir 26 at the end portion thereof are made different in at least either of cross-sectional area and length from the ink supply channels 27 communicating with the common ink reservoir 26 at other parts than the end portion, thereby making uniform jet characteristics of ink drops jetted through the nozzle orifices 13. That is, the ink supply amounts and the ink drop velocities are made uniform for raising the record quality. This means that, of ink paths from the ink supply channels 27 communicating with the common ink reservoir 26 through the pressure generating chambers 20 communicating with the ink supply channels 27 to the nozzle orifices 13 of the pressure generating chambers 20, the ink paths communicating with the common ink reservoir 26 in the narrowed areas 36 are made different in at least one of shape, length, and cross-sectional area from the ink paths communicating with the common ink reservoir 26 in other areas than the narrowed areas 36, whereby the velocities of ink drops jetted through the nozzle orifices 13 are made uniform.

Embodiments described below are intended to further enhance the record quality.

For easy understanding, a detailed description will be given although a part of the description is duplicate with that of the embodiments described above.

Figure 8:
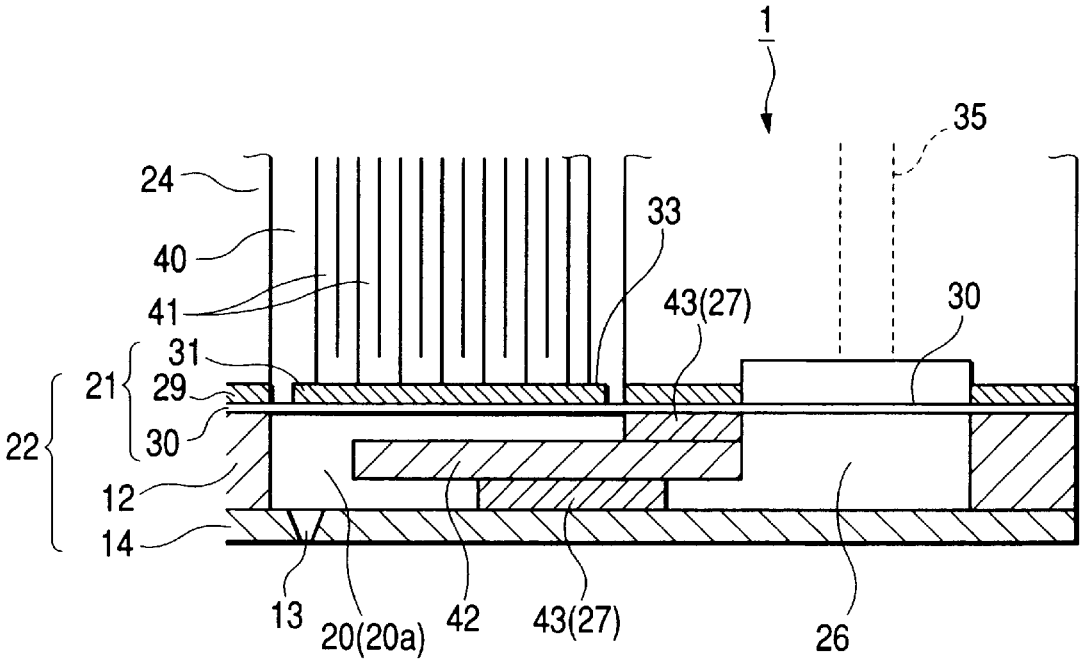
FIG. 8 is a sectional view to show the main part of the recording head taken on the X arrow in FIG. 10.
Figure 9:
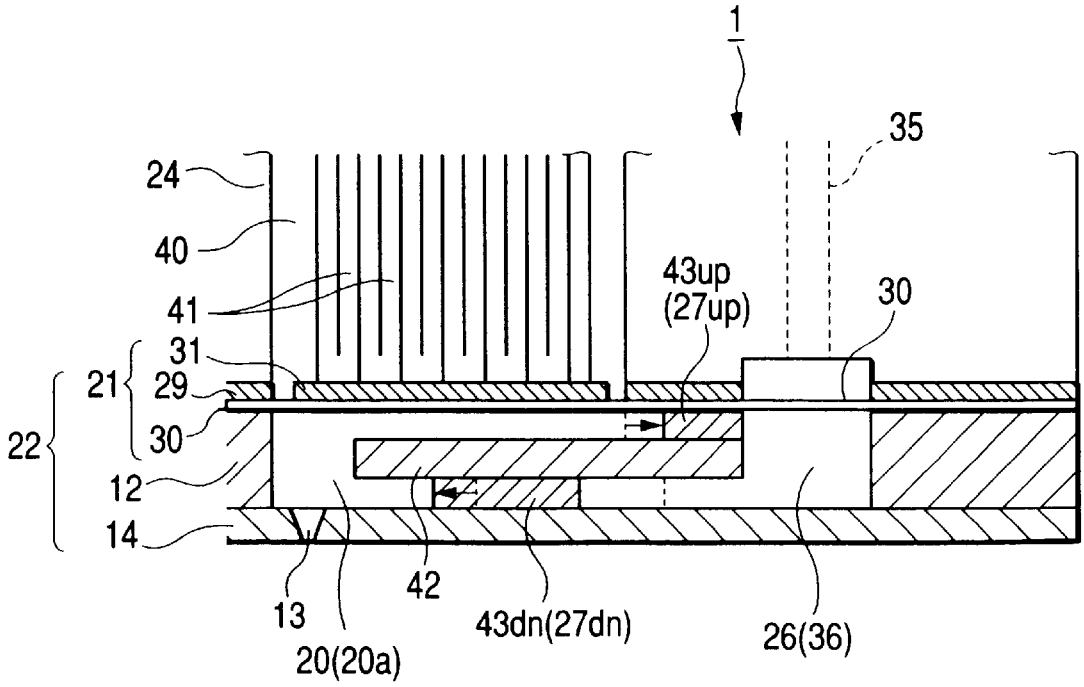
FIG. 9 is a sectional view to show the main part of the recording head taken on the Y arrow in FIG. 10.

A recording head 1 shown in FIGS. 8 and 9, like that of the above-described embodiments, is formed roughly by inserting piezoelectric vibrator 41 as pressure generating element into a housing chamber 40 of a head case 24 from one opening with the tips like comb teeth opposed to an opposite opening (window 33), joining a channel unit 22 to the surface of the head case 24 on the opening side (bottom face), and abutting and fixing the comb-teeth-like tips of the piezoelectric vibrator 41 against and to predetermined parts of the channel unit 22.

The channel unit 22, like that of the above-described embodiment, comprises a nozzle plate 14 and an elastic plate 21 deposited on both sides with a channel formation substrate 12 in between.

The nozzle plate 14 is a stainless thin plate formed with a plurality of nozzle orifices like rows at pitches corresponding to the dot formation density. In the embodiment, five rows of nozzle orifices 13 (96 nozzle orifices per row) are made at 0.141-mm pitches (180 dpi). The nozzle plate 14 may be molded integrally with any other member such as the channel formation substrate 12.

The channel formation substrate 12 deposited on one face of the nozzle plate 14 is a plate-like member formed with cavities arranged side by side which become pressure generating chambers 20 corresponding to the nozzle orifices 13 of the nozzle plate 14 in a state in which they are partitioned by partition walls, formed with a cavity which becomes a common ink reservoir 26 along the arrangement direction of the pressure generating chambers 20, and formed with cavities which become ink supply channels 27 by which the common ink reservoir 26 communicates with the pressure generating chambers 20.

Figure 10:
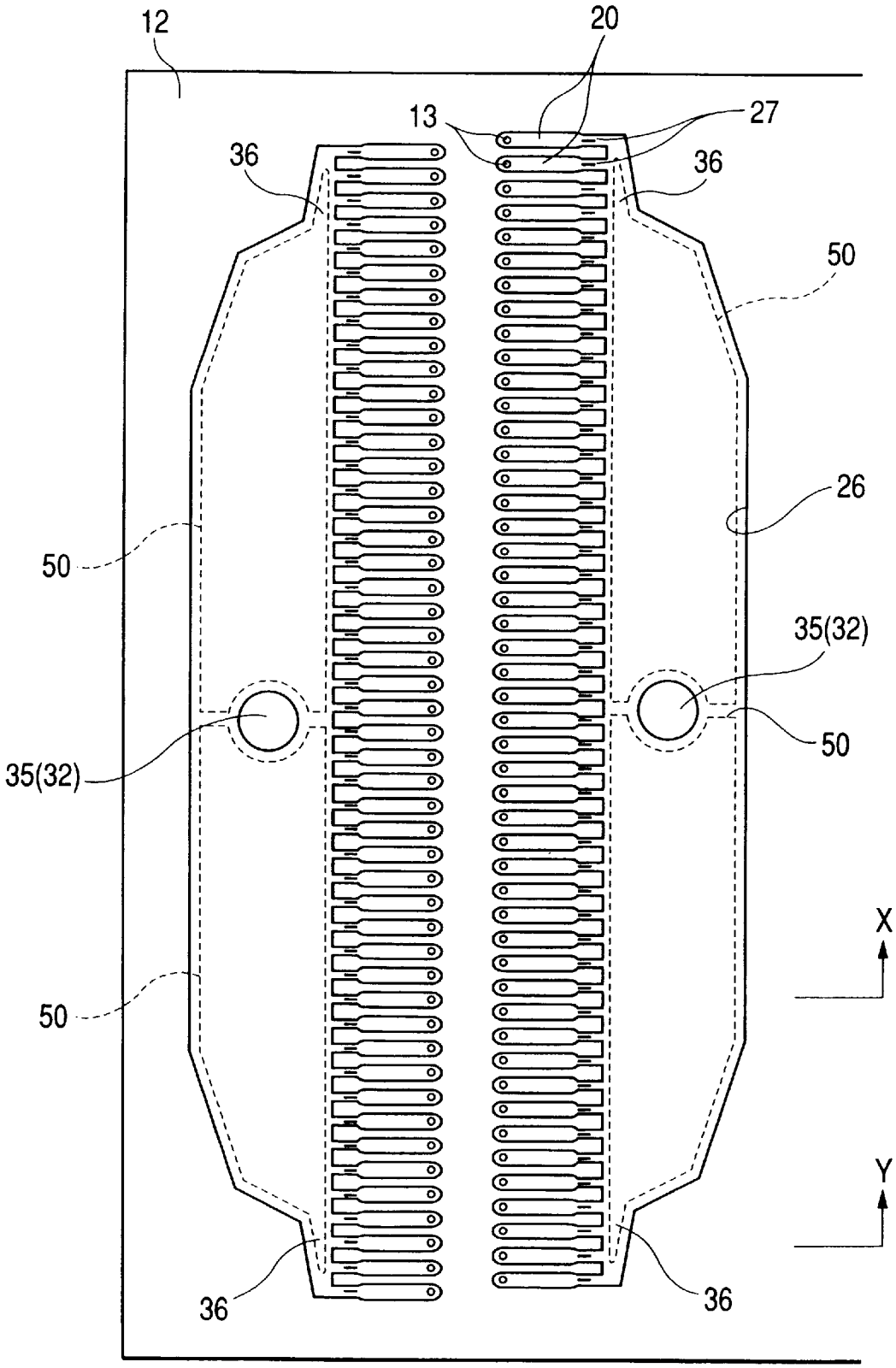
FIG. 10 is a plan view of a fourth embodiment of a channel formation substrate.

The common ink reservoir 26 is a chamber for supplying ink stored in an ink cartridge 9 to the pressure generating chambers 20; an ink supply passage 35 communicates with the common ink reservoir 26 almost at the center in the length direction of the common ink reservoir 26 and a narrowed area 36 with the flow passage width narrowed so as to decrease the cross-sectional area as compared with any other part is set in each end portion at a distance from the ink supply passage 35 (left and right end portions), as shown in FIG. 10. To form the narrowed area 36, with the side of the pressure generating chambers 20 remaining linear, the side on the opposite side to the pressure generating chambers 20 is warped or bent and is brought close to the pressure generating chambers 20. The portion between the left or right nearby portion of the ink supply passage 35 (namely, center portion) and the narrowed area 36 is inclined appropriately for connection; in the embodiment, the front portion of the narrowed area 36 is inclined to the pressure generating chamber 20 side at a steeper acute angle than any other portion, whereby the narrowed area 36 is formed at more than one stage.

The pressure generating chamber 20 is a chamber elongated in a direction orthogonal to the row of the nozzle orifices 13; a part of the pressure generating chamber 20 (nozzle orifice 13 side) is formed of a rectangular through hole 20*a* piercing the channel formation substrate 12 in the thickness direction thereof and other portions are formed of flat concave chambers partitioned up and down by a vertical partition wall 42 formed at the center in the thickness direction of the channel formation substrate 12. In the invention, all the 96 pressure generating chambers 20 are formed so as to have the same volume.

The ink supply channels 27 are passages by which the common ink reservoir 26 communicates with the pressure generating chambers 20. In embodiment shown in FIG. 11, a partition (shallow portion) 43 is formed between an entrance 27*a* opened in the common ink reservoir 26 side and an exit 27*b* opened in the pressure generating chambers 20 side and the flow passage width and the flow passage length are adjusted according to the dimensions of the shallow portion 43, whereby each inertance is adjusted. Particularly, in the embodiment, the inertance between the entrance 27*a* and the exit 27*b* of each ink supply channel 27 communicating with the common ink reservoir 26 in the narrowed area 36 is set smaller than the inertance of any other ink supply channel 27 communicating with the common ink reservoir 26 in other portions than the narrowed area 36, the inertance of the ink supply channel 27 as the ink supply channel 27 is positioned on the tip side is set smaller, and the volume of the pressure generating chamber 20 communicating with the ink supply channel 27 with the inertance set small is matched with the volume of any other pressure generating chamber 20 communicating with the common ink reservoir 26 in other portions than the narrowed area 36.

Figure 11:
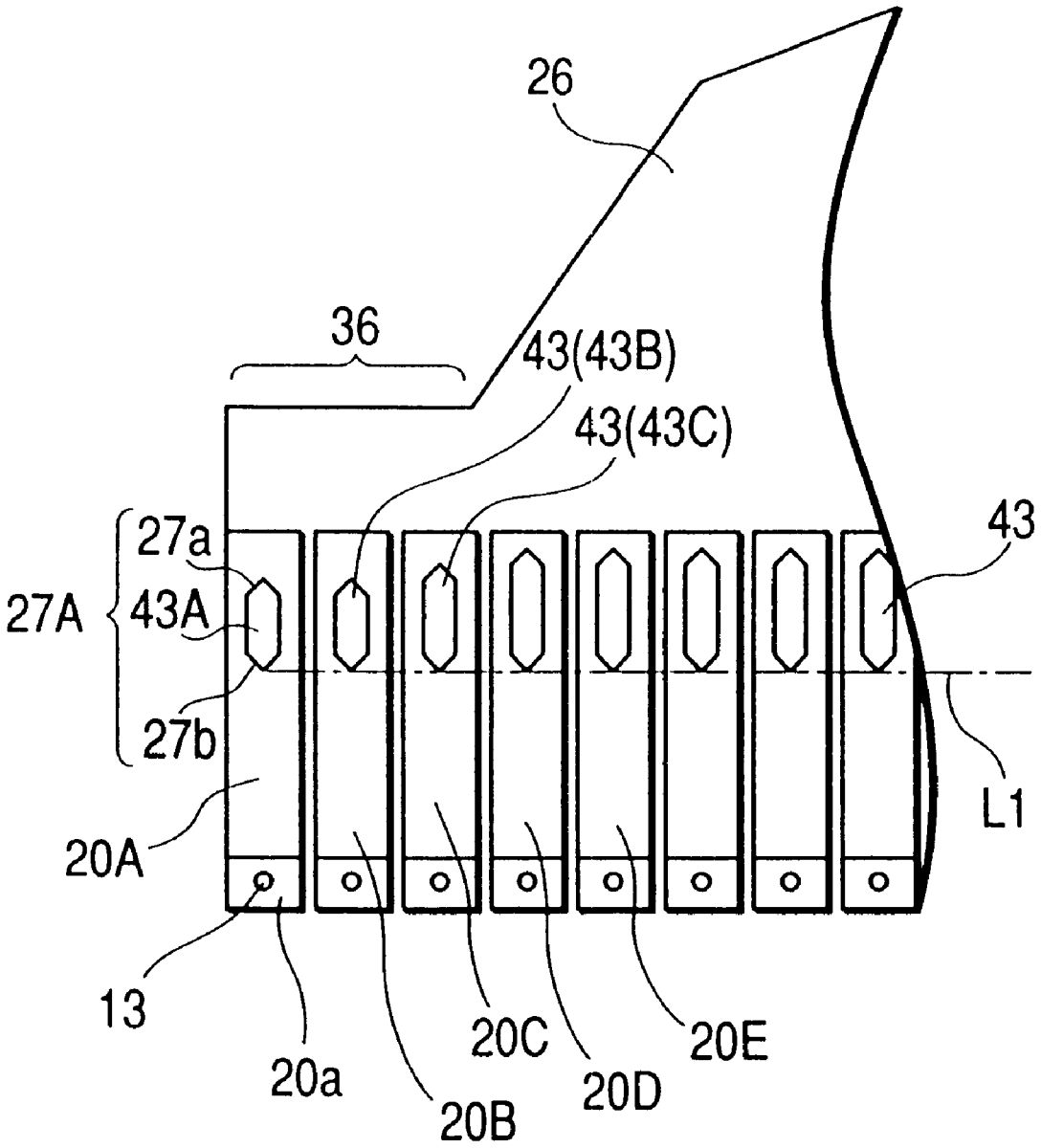
FIG. 11 is an enlarged view in the proximity of a narrowed area of a common ink reservoir.

Specifically, the width of shallow portion 43A of ink supply channel 27A corresponding to the outermost end of three pressure generating chambers 20A, 20B, and 20C communicating with the common ink reservoir 26 in the narrowed area 36 shown in FIG. 11 is made the minimum and the length is set the shortest, whereby the inertance of the ink supply channel 27A is set to the minimum; the shallow portion 43B positioned at the second outermost end adjoining the ink supply channel 27A is made a little wider than the shallow portion 43A, namely, is set to standard width and the length is set the shortest, whereby the inertance of the ink supply channel 27B is set to the second smallest inertance; and the shallow portion 43C positioned at the third outermost end adjoining the ink supply channel 27B is set to the standard width and the length is set a little longer than that of the first or second shallow portion, namely, is set to intermediate length, whereby the inertance of the ink supply channel 27C is set to the third smallest inertance.

Thus, the dimensions of the shallow portions 43 are changed for changing the cross-sectional area of the flow passage between the entrance 27*a* and the exit 27*b* of each ink supply channel 27, whereby the inertance of each ink supply channel is set smaller as the ink supply channel is positioned at the outermost end (tip of the narrowed area 36); the positions of the exits 27*b* of the ink supply channels 27, namely, the positions of the pressure chamber side end portions of the shallow portions 43 are aligned on a phantom line L1 along the arrangement direction of the pressure generating chambers 20, whereby the volumes of the pressure generating chambers 20 are made uniform.

The shallow portion 43 of the ink supply channel 27 of each of the pressure generating chambers 20D, 20E, . . . communicating with the common ink reservoir 26 in other portions than the narrowed area 36 is set to the same standard width as the shallow portion 43B at the second outermost end, the shallow portion 43C at the third outermost end and is set to the same standard length as the shallow portion 43C at the third outermost end. Therefore, the inertance values of the ink supply channels 27 are uniform as larger values than those of the three pressure generating chambers 20A, 20B, and 20C communicating with the common ink reservoir 26 in the narrowed area 36.

In the embodiment, as shown in FIG. 8, the elastic plate 21 serves as both a seal plate being deposited on an opposite face of the channel formation substrate 12 positioned on the opposite side to the nozzle plate 14 for sealing one opening face of the pressure generating chamber 20 and an elastic film (thin film part) being deposited on the opposite face of the channel formation substrate 12 for sealing one opening face of the common ink reservoir 26 and is of a double structure comprising a polymer film 30 of PPS, etc., laminated on a stainless plate 29. Since both the seal plate and the elastic film are formed of the same member, the stainless plate 29 of the portion functioning as the seal member, namely, the portion overlapping the pressure generating chamber 20 is etched to form a thick portion (island portion 31) like an island for abutting and fixing the tip of a piezoelectric vibrator 41, and the stainless plate 29 of the portion functioning as the elastic film, namely, the portion overlapping the common ink reservoir 26 is removed by etching for leaving only a film 30 (elastic film). An ink supply hole 32 communicating with the ink supply passage 35 for supplying ink into the common ink reservoir 26 is made in the area overlapping the common ink reservoir 26 (see FIG. 10).

In the described recording head 1, the piezoelectric vibrator 41 is expanded in the length direction of the vibrator, whereby the island portion 31 is pressed against the nozzle plate 14, the film (elastic film) 30 surrounding the island portion 31 becomes deformed, and the pressure generating chamber 20 is contracted. If the piezoelectric vibrator 41 is contracted in the length direction of the vibrator, the pressure generating chamber 20 is expanded due to elasticity of the elastic film 30. Expansion and contraction of the pressure generating chamber 20 are controlled, whereby an ink drop is jetted through the nozzle orifice 13.

When sucking through the nozzle orifice 13 by the operation of a capping unit 10 at the time of filling with ink or at the cleaning time, the narrowed areas 36 are formed in the common ink reservoir 26 at the left and right end portions thereof, thus the ink flow velocity in the portions is increased, so that bubbles are excluded without being caught and the remaining bubbles can be eliminated.

Figure 5:
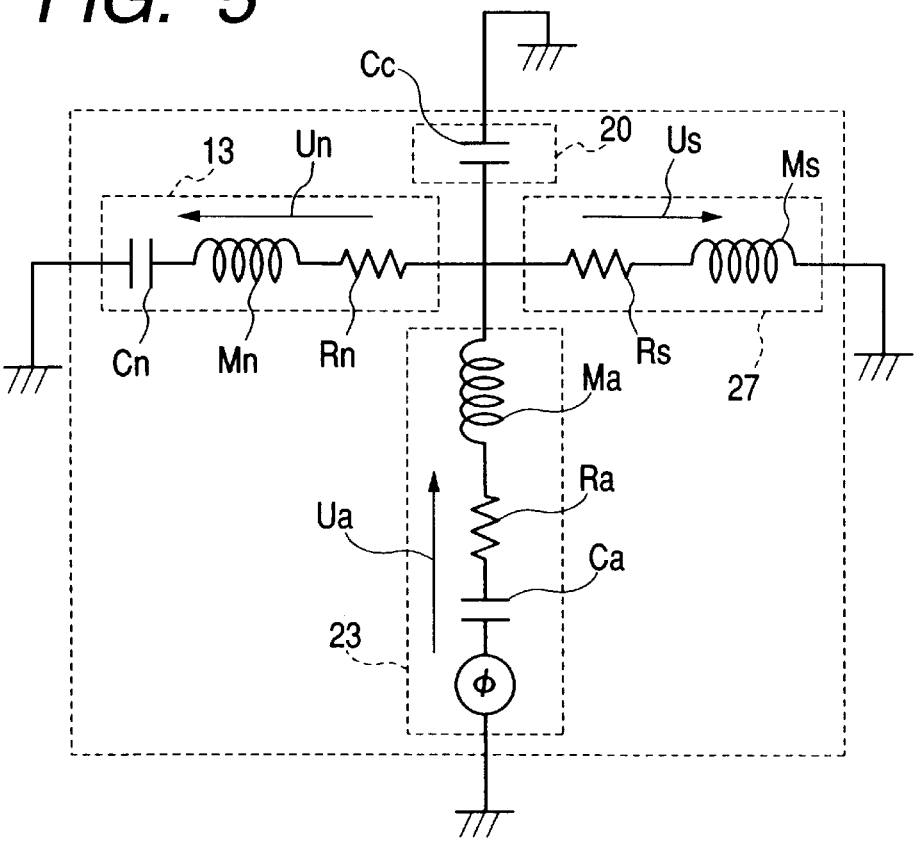
FIG. 5 is a schematic diagram representing a vibration system of the recording head by an equivalent circuit.

Thus, in the embodiment, the end portions of the common ink reservoir 26 are narrowed for decreasing the remaining bubbles and although the end portions of the common ink reservoir 26 are narrowed, the jet characteristics of the nozzle orifices 13 are made uniform by adjusting (correcting) the inertance of the ink supply channels 27. The jet characteristics will be discussed below:

A vibration system in the recording head 2 can be represented by an equivalent circuit shown in FIG. 5. Here, symbol M denotes inertance of the inertia component of a medium [Kg/m$^4$], symbol Ma denotes inertance in the piezoelectric vibrator 41, symbol Mn denotes inertance in the nozzle orifice 13, and symbol Ms denotes inertance in the ink supply port 27. Symbol R denotes resistance of the internal loss of a medium [N•s/m$^5$], symbol Rn denotes resistance in the nozzle orifice 13, and symbol Rs denotes resistance in the ink supply port 27. Symbol C denotes compliance of volume change per unit pressure [m$^5$/N], symbol Cc denotes compliance of the pressure generating chamber 20, symbol Ca denotes compliance in the piezoelectric vibrator 41, and symbol Cn denotes compliance in the nozzle plate 14. Symbol P denotes pressure generated with time by the piezoelectric vibrator 41, in other words, equivalent pressure into which voltage pulses applied to the piezoelectric vibrator 41 are converted.

The compliance of the pressure generating chamber 20, Cs, consists mainly of compliance of the elastic plate 21, Cs, and ink compliance C.ink. The ink compliance C.ink can be represented as in the following expression (1):

$$C.ink = \frac{V}{\rho c^2} \tag{1}$$

where V is the volume of the pressure generating chamber 20, p is the ink density, and c is the velocity of sound in the ink.

Here, p and c are constant and thus C.ink can also be represented as:

$$C.ink = kV \text{ (k: constant)} \tag{2}$$

The compliance of the pressure generating chamber 20, Cc, relates to each compliance of the partition wall of the channel formation substrate 12 functioning as the inner wall face of the pressure generating chamber 20, the elastic plate 21, and the nozzle plate 14 forming the pressure generating chamber 20. Letting the compliance of the components of the pressure generating chamber 20 be C.str, this C.str is volume change ΔV relative to pressure change ΔP and can be represented as in the following expression (3):

$$C.str = \frac{\Delta V}{\Delta P} \tag{3}$$

If, of the compliance component of the recording head 1, the percentage of the compliance C.ink of ink in the pressure generating chamber 20 is made larger than the percentage of the compliance C.str of the pressure generating chamber 20 components such as the partition wall and the elastic plate 21 forming the pressure generating chamber 20 (C.ink>C.str), the compliance of the recording head becomes hard to be affected by the work accuracy of the pressure generating chamber components such as the partition wall of the channel formation substrate 12 and the elastic plate 21, particularly the work state of the island portion 31 of the elastic plate 21 and an error of the thickness of the film 30. In other words, if the percentage depending on the compliance of ink in the pressure generating chamber 20, of the factors determining the compliance of the recording head 1 is increased relatively, the percentage depending on the machining accuracy of the recording head 1 is lowered relatively, whereby variations in the compliance of the recording head 1 can be lessened.

The jet characteristics of the nozzle orifices 13 of the pressure generating chambers 20 connected to the narrowed area 36 of the common ink reservoir 26 can be matched with the jet characteristics of the nozzle orifices 13 of the pressure generating chambers 20 connected to other areas by making the volumes of the pressure generating chambers 20 constant, thereby making uniform ink pressure resonance cycles in the pressure generating chambers 20. The ink pressure resonance cycle Tc can be represented by expression (4), the inertance of the ink supply channel 27, Ms, can be represented by expression (5), and parallel calculation of inertance Mn and inertance Ms can be represented by expression (6):

$$Tc = 2\pi\sqrt{MCc} \tag{4}$$

$$Ms = \frac{\rho L}{nS} \tag{5}$$

$$M = \frac{Mn + Ms}{Mn \cdot Ms} \tag{6}$$

where ρ is ink density, S is the cross-sectional area of the ink supply channel 27, and n is the number of parallel flow passages of the ink supply ports 24.

To make uniform ink pressure resonance cycles Tc, it is understood that inertance and pressure need to be made uniform from expression (4). In this point, in the embodiment, for the ink supply channels 27 connected to the narrowed area 36 of the common ink reservoir 26, the inertance between the entrance 27*a* and the exit 27*b* of each ink supply channel 27 becomes smaller as the ink supply channels 27 are placed at the end portions of the common ink reservoir 26 by adjusting the dimensions of the shallow portions 43.

Thus, the substantial inertance is made the same by correcting the inertance of the ink supply channel 27 to small inertance for the inertance component added in the portion as the common ink reservoir 26 is narrowed (tapered off). Further, the exits 27*b* of the ink supply channels 27 are aligned, so that the compliances Cc of the pressure generating chambers 20 are also the same.

Therefore, by making the correction, the ink pressure resonance cycle of each ink supply channel 27 connected to the common ink reservoir 26 in the narrowed area 36 thereof becomes equal to that of each ink supply channel 27 connected to the common ink reservoir 26 in other areas than the narrowed area 36. Thus, the jet characteristics of the nozzle orifices 13 can be made uniform and it can be expected that a good-quality image will be provided.

To furthermore make uniform jet characteristics, the flow passage resulting from adding the length from the start end of the narrowed area 36 to each entrance 27*a* to the flow passage between the entrance 27*a* and the exit 27*b* of each ink supply channel 27 communicating with the common ink reservoir 26 in the narrowed area 36 thereof is assumed to be an hypothetical flow passage of the ink supply channel 27 and the inertance in each hypothetical flow passage is matched with the inertance in the flow passage from the entrance 27*a* to the exit 27*b* of each ink supply channel 27 communicating with the common ink reservoir 26 in any other area than the narrowed area 36.

In doing so, an adjustment can be made including the inertance added as the end portion of the common ink reservoir 26 is narrowed to form the narrowed area 36; both a decrease in the remaining bubbles and constant jet characteristics of the nozzle orifices 13 can be accomplished.

Figure 12:
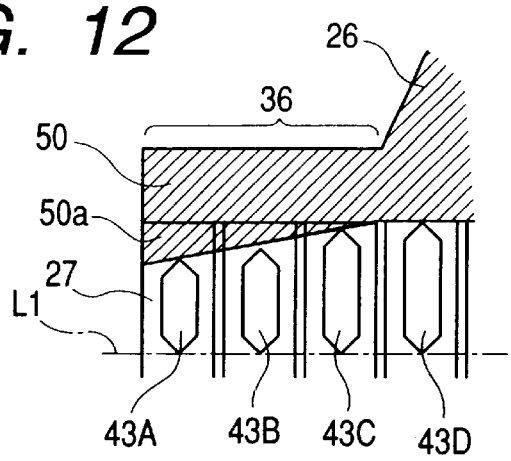
FIG. 12 is a schematic representation of the main part of one embodiment wherein a compliance enlarged area is formed in accordance with shortening of ink supply channels.

For the compliance of the common ink reservoir 26, if the end portion of the common ink reservoir 26 is narrowed, the width of the film 30 in the proximity of each ink supply channel 27 connected to the common ink reservoir 26 in the narrowed area 36 thereof (compliance area 50) is narrowed, so that the compliance locally decreases in the proximity of the ink supply channels 27. This leads to a factor for the fact that when ink is jetted, the capability of absorbing pressure of ink flowing backward from the ink supply channels 27 decreases at the end portion of the common ink reservoir 26, changing the ink jet characteristic at the end portion. To overcome this, for example, as shown in FIG. 12, as the end portions of the shallow portions 43A, 43B, and 43C on the common ink reservoir 26 side (end portions on the entrance 27*a* side) retreat to the pressure generating chamber 20 side (the lengths are short), the compliance area 50 of the common ink reservoir 26 may be enlarged to the ink supply channel 27 side in accordance with the lengths of shortening the ink supply channels 27.

Thus, if the composition of increasing a compliance enlarged area 50*a* is adopted, the compliance of the narrowed area 36 of the common ink reservoir 26 is enlarged, the added inertance of the narrowed area 36 is decreased substantially, and the correction amounts to the ink supply channels 27 connected to the narrowed area 36 can be reduced.

Figure 13:
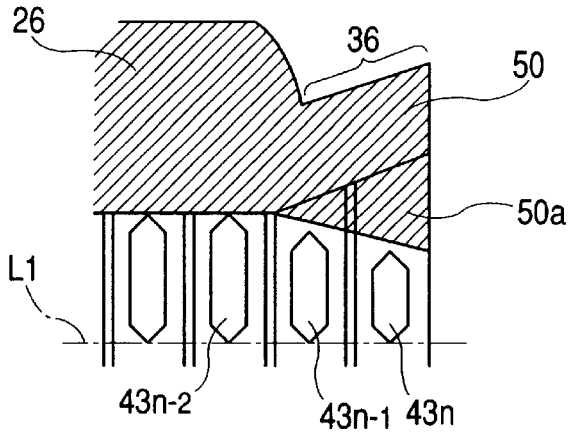
FIG. 13 is a schematic representation of the main part of another embodiment wherein a compliance enlarged area is formed in accordance with shortening of ink supply channels.

The tip of the narrowed area 36 of the common ink reservoir 26 may be formed slantingly in a direction away from the pressure generating chambers 20, as shown in FIG. 13, for convenience of working the channel formation substrate 12, in which case the side of the film 30 (compliance area 50) on the pressure generating chamber 20 side may be made linear to the end portion or may be enlarged to the pressure generating chamber 20 side for increasing the compliance enlarged area 50*a*.

To divide each ink supply channel 27 into a flow passage 27 dn on the nozzle orifice 13 side (nozzle plate 14 side) and a flow passage 27 up on the elastic plate 21 side to form the ink supply channel 27, as shown in FIGS. 8 and 9, a restriction is put on the position of the shallow portion 43 formed in the flow passage 27 up on the elastic plate 21 side to avoid interference with the island portion 31. Then, as shown in FIG. 9, shallow portion 43 dn on the nozzle plate 13 side may be advanced to the pressure generating chamber 20 side by distance as much as shallow portion 43 up on the elastic plate 21 side is retreated to the common ink reservoir 26 side, whereby the volumes of the pressure generating chamber 20 are made constant. The inertance between the entrance and the exit of the ink supply channel 27 up on the elastic plate 21 side and the inertance between the entrance and the exit of the ink supply channel 27 dn on the nozzle plate 13 side may be corrected by adjusting the width and length dimensions of the shallow portions 43 up and 43 dn. Therefore, the inertance of the ink supply channel 27 up on the elastic plate 21 side and the inertance of the ink supply channel 27 dn on the nozzle plate 13 side may differ, and the flexibility of design is enlarged.

Figure 14:
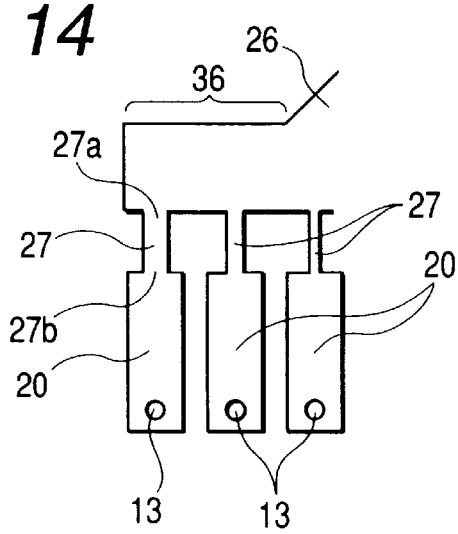
FIG. 14 is a schematic representation of the main part of one embodiment wherein the compliance of an ink supply channel is corrected by changing the flow passage width of the ink supply channel.

In the embodiment, the shallow portion 43 is provided at an intermediate point of each ink supply channel 27 for separating the ink supply flow passage, but the ink supply channel 27 in the invention is not limited thereto; the inertance between the entrance 27*a* and the exit 27*b* of each ink supply channel 27 may be able to be corrected. For example, as shown in FIG. 14, it may be corrected by changing the flow passage widths of the ink supply channels 27, namely, widening the flow passages placed at the tip of the narrowed area 36. Thus, if the flow passage widths of the ink supply channels 27 are changed, the inertance can be corrected as seen from expression (5) mentioned above.

In the embodiments described so far, the inertance between the entrance 27*a* and the exit 27*b* of each ink supply channel 27 is corrected, but the scope of the invention is not limited thereto; the inertance in the range also containing the narrowed area 36 of the common ink reservoir 26 may be adjusted.

In the description of the embodiments, the piezoelectric vibrator 41 is taken as an example as the pressure generating element 23, but the pressure generating element 23 of the invention is not limited thereto. For example, pressure in the pressure generating chamber 20 may be changed by providing a heating element for generating bubbles in ink.

Figure 15:
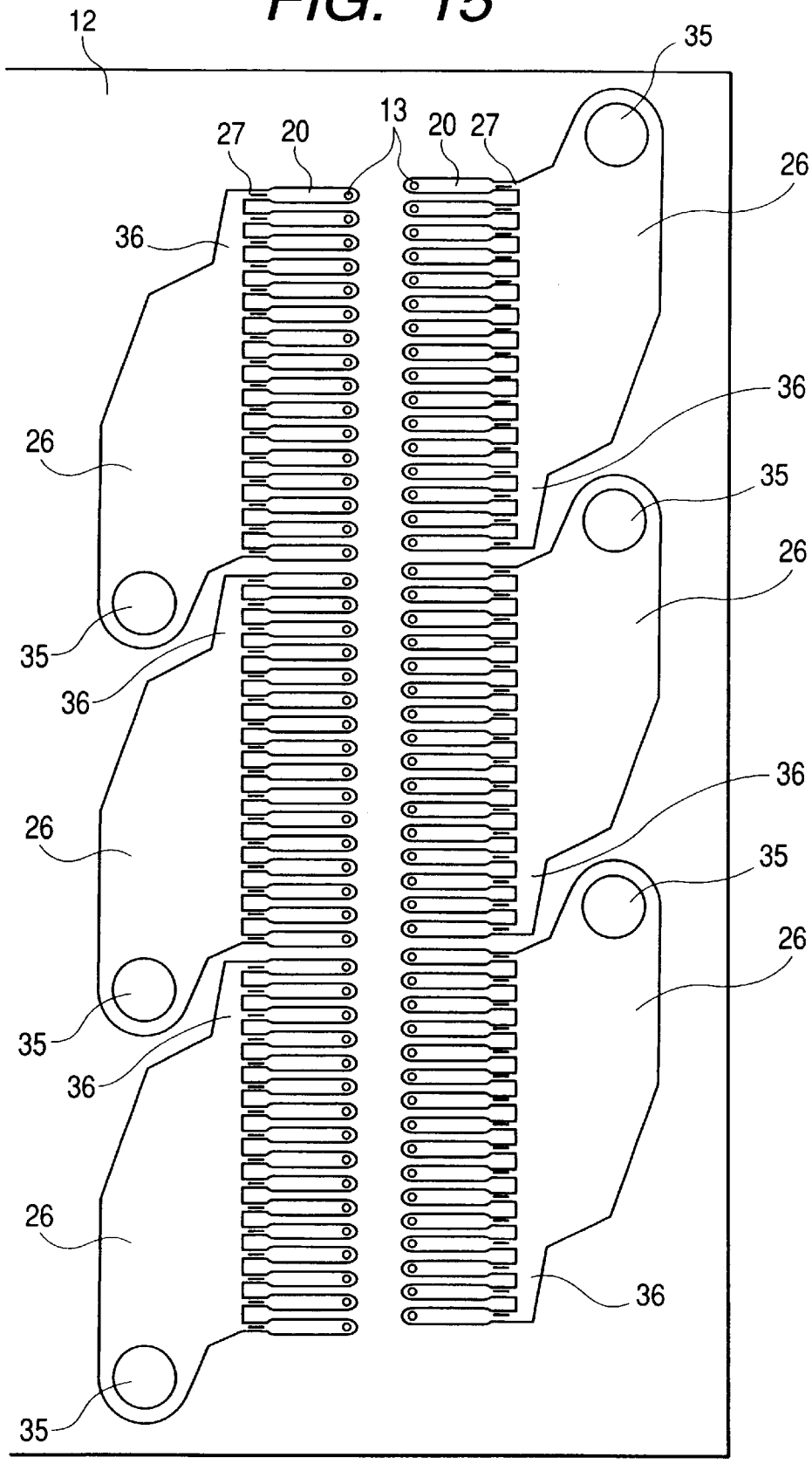
FIG. 15 is a plan view of another embodiment wherein one row of nozzle orifices is divided into groups and common ink reservoirs are provided in a one-to-one correspondence with the groups.

One common ink reservoir 26 is provided for one row of the nozzle orifices 13, but as shown in FIG. 15, one row of the nozzle orifices 13 may be classified into groups and common ink reservoirs may be provided in a one-to-one correspondence with the groups. That is, two or more common ink reservoirs (in FIG. 15, three chambers) may be provided for one row of the nozzle orifices 13 so that more than one color ink is jetted through one row of the nozzle orifices 13. In the embodiment shown in FIG. 15, like the above-described embodiment, a narrowed area 36 is formed at the end portion of each common ink reservoir 26 at a distance from an ink supply passage 35 and the cross-sectional area and the length of each ink supply channel 27 communicating with the narrowed area 36 are made different from those of each ink supply channel 27 communicating with the common ink reservoir 26 in any other area than the narrowed area 36 so that the velocities and the mounts of ink drops jetted through the nozzle orifices 13 become uniform.

As described throughout the specification, according to the invention, if the number of nozzles per row is increased and the length of the common ink reservoir becomes long, the ink velocities and the ink amounts in the nozzle orifices in the end portion can be made uniform with the ideal shape of the common ink reservoir excellent in the bubble excluding capability, and the ink vibration can be attenuated efficiently, whereby image recording for providing excellent record quality at high speed is enabled.

That is, in the end portion of the common ink reservoir at a distance from the ink supply tube, the common ink reservoir has a narrowed area having a cross-sectional area decreased as compared with any other portion, whereby bubbles can be prevented from remaining at the time of filling with ink or at the cleaning time of sucking through the nozzle orifices, and the record quality can be enhanced.

Inertance of each of the ink supply channels communicating with the common ink reservoir in the narrowed area is set smaller than inertance of each of the ink supply channels communicating with the common ink reservoir in any other portion than the narrowed area, inertance of each ink supply channel is set smaller as the ink supply channel is positioned at the tip of the common ink reservoir, and the volumes of the pressure generating chambers communicating with the ink supply channels with the inertance set small are matched with the volumes of the pressure generating chambers communicating with the common ink reservoir in any other portion than the narrowed area, so that the ink pressure resonance cycles in the pressure generating chambers can be made uniform.

Therefore, the jet characteristics of the nozzle orifices positioned at the end portion can be matched with those of the nozzle orifices at the center. Thus, the image quality is furthermore enhanced and the recording head can cope with upsizing of a record target and speeding up image record.

Thus, according to the invention, both the bubble excluding capability at the end portion of the common ink reservoir and constant jet characteristics can be provided.

Furthermore, according to the present invention, the speed of the ink drop ejected from the respective nozzle orifices can be fit within ±5% of a desired value when the respective pressure generating chambers are pressurized by the pressure generator in accordance with the substantially same drive signal.

What is claimed is:

1. An ink jet recording head comprising:

a common ink reservoir;

an ink supply passage for supplying ink to the common ink reservoir;

a plurality of cavities arranged in a longitudinal direction of the common ink reservoir, which are to be pressure generating chambers; and an ink supply channel communicating the common ink reservoir and the respective cavities, wherein at least one ink supply channel situated in the vicinity of at least one longitudinal end portion of the common ink reservoir has at least one of a different cross-section area and a different length from the other ink supply channels.

2. The ink jet recording head as set forth in claim 1, wherein the ink supply passage communicates with the common ink reservoir substantially at the center of the longitudinal direction thereof.

3. The ink jet recording head as set forth in claim 1, wherein a cross-sectional area of the common ink reservoir is reduced at the end portion thereof.

4. The ink jet recording head as set forth in claim 3, wherein the cross-sectional area is reduced stepwise.

5. The ink jet recording head as set forth in claim 1, wherein vibration damping coefficients of the respective ink supply channels are substantially the same.

6. The ink jet recording head as set forth in claim 1, wherein a partition divides each ink supply channel into a plurality of channels.

7. The ink jet recording head as set forth in claim 1, wherein the respective ink supply channels and a part of the respective cavities are divided by a partition wall such that an upper section and a lower section are defined, and the divided sections are communicated with each other.

8. The ink jet recording head as set forth in claim 7, wherein at least one of the upper section and the lower section of the ink supply channels are divided by at least one partition into the plural channels.

9. The ink jet recording head as set forth in claim 8, wherein the partitions provided in the respective upper sections of the ink supply channels are arranged in accordance with positions of piezoelectric elements to be mounted on a top wall of the respective cavities, and wherein the partitions provided in the respective lower sections of the ink supply channels are arranged in accordance with the positions of the partitions provided in the upper sections such that the volume of the respective cavities is made constant.

10. The ink jet recording head as set forth in claim 7, wherein an inertance of the respective upper sections of the ink supply channels and an inertance of the respective lower sections of the ink supply channels are different.

11. An ink jet recording head comprising:

a common ink reservoir in which a cross-sectional area of at least one longitudinal end portion is reduced;

an ink supply passage for supplying ink to the common ink reservoir;

a plurality of cavities arranged in a longitudinal direction of the common ink reservoir, which are to be pressure generating chambers; and an ink supply channel communicating with the common ink reservoir and the respective cavities, wherein an inertance of an ink supply channel situated in the vicinity of the longitudinal end portion of the common ink reservoir becomes increasingly smaller than the inertance of the other ink supply channels towards the longitudinal end portion of the common ink reservoir.

12. The ink jet recording head as set forth in claim 11, wherein the volume of the respective cavities is made constant.

13. The ink jet recording head as set forth in claim 11, wherein the ink supply channel situated in the vicinity of the end portion of the common ink reservoir has at least one of a different cross-section area and a different length from the other ink supply channels to determine the inertance thereof.

14. The ink jet recording head as set forth in claim 11, wherein the ink supply channels communicate with the associated cavities on an hypothetical line extending in the arrangement direction of the cavities.

15. The ink jet recording head as set forth in claim 11, wherein the length of the ink supply channel situated in the vicinity of the end portion of the common ink reservoir is reduced, and wherein a compliance region of the common ink reservoir in the vicinity of the end portion thereof is expanded in accordance with the reduced amount of the length of the ink supply channel.

16. The ink jet recording head as set forth in claim 11, wherein the cross-sectional area is reduced stepwise.

17. The ink jet recording head as set forth in claim 11, wherein a partition divides each ink supply channel into a plurality of channels.

18. An ink jet recording head comprising:

a common ink reservoir having a narrowed portion in which a cross sectional area of at least one longitudinal end portion thereof is reduced;

an ink supply passage for supplying ink to the common ink reservoir;

a plurality of cavities arranged in a longitudinal direction of the common ink reservoir, which are to be pressure generating chambers; and an ink supply channel communicating the common ink reservoir and the respective cavities;

wherein a part defined as a sum of the length of an ink supply channel situated in the narrowed portion of the common ink reservoir and the length from a start point of the narrowed portion of the common ink reservoir to an inlet of the ink supply channel has a first inertance, wherein an ink supply channel which is not situated in the narrowed portion has a second inertance, and wherein the first inertance has the same value as the second inertance.

19. The ink jet recording head as set forth in claim 18, wherein the volume of the respective cavities is made constant.

20. The ink jet recording head as set forth in claim 18, wherein the ink supply channel situated in the narrowed portion of the common ink reservoir has at least one of a different cross-section area and a different length from the other ink supply channels to determine the inertance thereof.

21. The ink jet recording head as set forth in claim 18, wherein the ink supply channels communicate with the associated cavities on an hypothetical line extending in the arrangement direction of the cavities.

22. The ink jet recording head as set forth in claim 18, wherein the length of the ink supply channel situated in the narrowed portion of the common ink reservoir is reduced; and wherein a compliance region of the common ink reservoir in the narrowed portion thereof is expanded in accordance with the reduced amount of the length of the ink supply channel.

23. The ink jet recording head as set forth in claim 18, wherein the cross-sectional area is reduced stepwise.

24. The ink jet recording head as set forth in claim 18, wherein a partition divides each ink supply channel into a plurality of channels.

25. An ink jet recording apparatus comprising the ink jet recording head as set forth in any of claims 1 to 30.

* * * * *